US006145346A

United States Patent [19]

Hanyu et al.

[11] Patent Number: 6,145,346

[45] Date of Patent: Nov. 14, 2000

[54] OIL COLLECTION SYSTEM FOR A CIRCULAR KNITTING MACHINE

[75] Inventors: Toshikatsu Hanyu, Osaka; Toshihiro Okayama, Hyogo; Shigeuji Koami, Hyogo; Kozo Taniguchi, Hyogo, all of Japan

[73] Assignee: Precision Fukuhara Works, Ltd., Japan

[21] Appl. No.: 09/467,339

[22] Filed: Dec. 20, 1999

[30] Foreign Application Priority Data

Dec. 21, 1998 [JP] Japan ..... 10-362435

[51] Int. Cl.[7] ..... D04B 15/94

[52] U.S. Cl. ..... 66/8

[58] Field of Search ..... 66/7, 8, 13, 17, 66/19, 56, 57, 79, 90, 114, 1 R, 31; 184/106

[56] References Cited

U.S. PATENT DOCUMENTS 3,802,223 4/1974 Wright et al. ..... 66/8

5,154,259 10/1992 Magome ..... 66/8

5,388,431 2/1995 Izumi ..... 66/8

5,493,876 2/1996 Tsuchiya .

6,003,343 12/1999 Plath ..... 66/8

*Primary Examiner*—Danny Worrell

*Attorney, Agent, or Firm*—Alston & Bird LLP

[57] ABSTRACT

A circular knitting machine is provided and includes a cylinder, a gear ring supporting and rotating the cylinder, a cam holder, a cam ring supporting the cam holder and a bed supporting the cam ring and the gear ring, and further including an oil collection system for controlling and collecting leaked oil to prevent the oil from staining the fabric being knit. The oil collection system includes a protrusion-free lower surface on said gear ring that is inclined outwardly and downwardly, a chamber in said bed for containing machine parts, an oil collecting cavity in the bed underneath the inclined surface of the gear ring and a reclamation pipe for reclaiming collected oil.

9 Claims, 1 Drawing Sheet

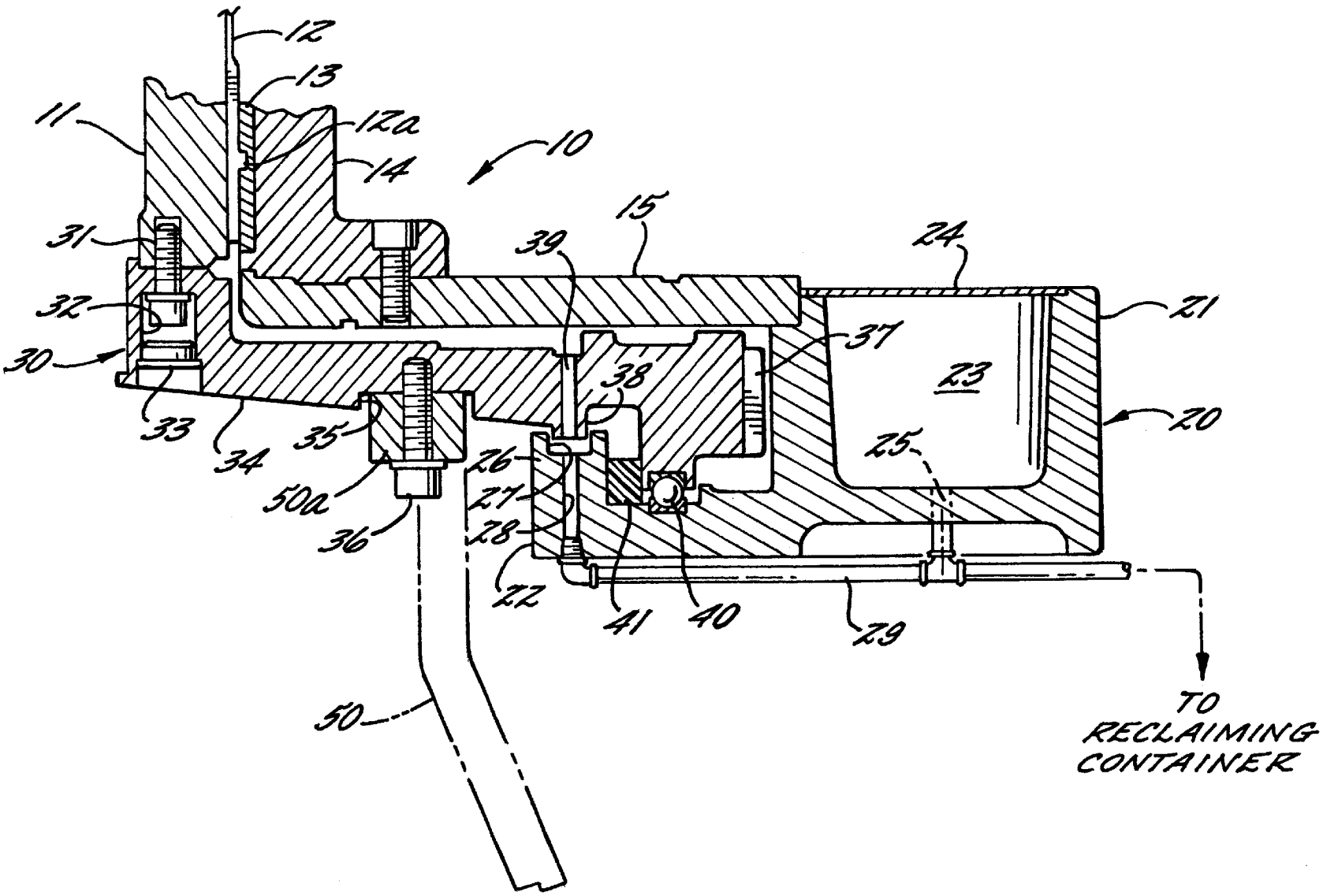
TO RECLAIMING CONTAINER
10
11
12
13
12a
14
15
20
21
22
23
24
25
26
27
28
29
30
31
32
33
34
35
36
37
38
39
40
41
50
50a

OIL COLLECTION SYSTEM FOR A CIRCULAR KNITTING MACHINE

FIELD OF THE INVENTION

The present invention relates to circular knitting machines and more particularly to an oil collection system for such knitting machines.

BACKGROUND OF THE INVENTION

Circular knitting machines have a multiplicity of moving parts, such as needles, sinkers, jacks, selectors, control cams, etc., that are necessary for knitting a fabric. These parts are mounted in compact spaces in close proximity to each other and since they operate at high speed, it is necessary to lubricate them by the application of oil thereto.

Since the knitted fabric is taken down inside the rotating cylinder and is flattened and wound on a take-up roll beneath the cylinder, oil stains on the knitted fabric is a too frequent problem, which significantly reduces or depreciates the value of the knitted fabric resulting in financial loss to the fabric manufacturer. Such oil leaks occur by oil running down the cylinder and along the gear ring and dripping therefrom onto the fabric roll and by oil collecting on the cam ring and running along the upper surface of the bed supporting the cam ring and dripping onto the fabric inside the machine through holes for wiring and piping.

Attempts at solving this problem have been proposed previously, but have not been successful or have created additional problems or have effected adversely the operation of the knitting machine. One example of a proposed attempt is the provision of an oil pan inside the knitting machine below the gear ring and bed. Because space is very scarce in a circular knitting machine, the space occupied by such an oil pan means that the ease of operation of the knitting machine is sacrificed. Also, it is very difficult to remove oil from the pan and to remove the pan for cleaning. Consequently, this proposal has not been found to be a realistic solution to the problem.

A very common practice is to attempt to have a worker wipe off the oil as it leaks and before it drips onto the fabric. It can readily be appreciated that timing in such an endeavor is critical and results have been poor.

SUMMARY OF THE INVENTION

With the foregoing in mind, it is an object of the present invention to provide an oil collection system that effectively removes and reclaims leaked oil and thereby prevents the fabric from being stained.

This object of the present invention is accomplished by providing a simple and effective oil collection system which controls and directs the oil once it reaches the gear ring to a collection means located on the inner side of the bed. The collected oil in the collection means is removed and piped to a reclaiming container outside the knitting machine.

BRIEF DESCRIPTION OF THE DRAWINGS

The foregoing and other objects and advantages of the invention, and the manner in which the same are accomplished, will be more readily understood when taken in conjunction with the accompanying detailed description and drawings in which:

The FIGURE of the drawing is a fragmentary vertical section view of a circular knitting machine incorporating the features of the present invention.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now more specifically to the drawing, there is illustrated a circular knitting machine, generally indicated at 10, including a cylinder 11 having vertical grooves in the outer periphery thereof in which knitting needles 12 are slidably mounted. Needles 12 have actuating butts 12*a* thereon running in cam tracks in control cams 13 as cylinder 11 rotates to move needles 12 between their various positions.

Control cams 13 are supported by a cam holder or block 14 mounted on a cam ring 15. A bed, generally indicated at 20, is supported by several legs (not shown) and includes an outer portion 21 on which cam ring 15 is supported. Bed 20 also includes an inner portion 22 which underlies the outer portion of cam ring 15. Outer portion 22 of bed 20 includes a large cavity or chamber 23 for receipt and containment of piping, wiring and other machine parts. Chamber 23 has a concave bottom and its top is closed by a cover 24. A waste oil drain opening 25 is provided in the bottom of chamber 23 to drain oil from chamber 23 to the lower surface of bed 20.

Inner portion 22 of bed 20 includes an inner, upstanding rim 26 having an oil collecting groove or cavity 27 in the upper surface thereof. Oil collection groove 27 has an oil drain opening or openings 28 extending from the bottom of groove 27 to the bottom of inner portion 22 of bed 20. A drain pipe 29 is connected to drain openings 25 and 28 for draining the oil collected in chamber 23 and oil collection groove 27 to a reclaiming container.

A gear ring, generally indicated at 30, is connected to the bottom of cylinder 11 by bolts 31, only one of which is shown, penetrating through counterbored holes 32 in gear ring 30 into internally threaded holes in the bottom of cylinder 11. The counterbore of holes 32 is deeper than the length of the head of bolt 31 and an oil-leakage-preventing cap 33 seals the counterbore of hole 32 below bolt 31.

An upper end 50*a* of a driving bar 50 is fixed to the lower surface 34 of gear ring 30 in a counterbore 35 by a bolt 36. Another driving bar (not shown) is similarly connected to a diametrically opposite portion of gear ring 30 and such driving bars 50 support and rotate a knitted fabric take-up roll with cylinder 11 in a manner that is not shown, but conventional.

The lower surface 34 of gear ring 30 is inclined downwardly from the inner portion thereof that is connected to cylinder 11 toward the outer periphery which has gear teeth 37 thereon. Preferably, the angle of inclination of the lower surface 34 is between about 1 to 8 degrees, and more preferably, between about 3 to 5 degrees. Conventionally, the lower surface of this gear ring is horizontal as is shown in U.S. Pat. No. 5,493,876.

Because of this inclination, any oil that leaks onto gear ring 30 and runs down onto the lower surface 34 will not drip down onto the fabric, but will run along the downwardly and outwardly inclined surface 34 toward the outer periphery of gear ring 30. Such oil will not drip along nor from the driving bars 50, but instead will detour around the counterbores 35 and continue on toward the outer periphery.

Immediately above oil collection groove 27, gear ring 30 has a rib 38 on its surface 34 and extending downwardly therefrom. Rib 38 extends entirely around the gear ring 30 to terminate the inclined lower surface 34 and to cause oil running outwardly along surface 34 to be diverted downwardly and to drip into collection groove 27. Gear ring 30 has drain holes 39 (only one of which is shown) extending from the upper surface thereof to the lower surface of rib 38 immediately above collection groove 27. Accordingly, any oil that collects on the upper surface of the gear ring 30 will drain off through drain holes 39 into collection groove 27. Thereafter, the oil collected in collection groove 27 will drain through drain opening 28 into pipe 29 and thence to the reclaiming container.

Gear ring 30 is mounted for rotation on bed 20 by a bearing or bearings 40 adjacent which is a seal 41. Gear ring 30 is driven in rotation by a suitable drive means, such as an electric motor (not shown), which is conventional.

In accordance with this invention, there is provided a gear ring 30 whose lower or bottom surface is free of any protrusions from which oil will tend to drip onto the fabric and which causes oil to flow into the collection groove 27 from which it is reclaimed. Similarly, oil from the upper surface of gear ring 30 and from chamber 23 is also drained into collection groove 27 and pipe 29, respectively.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. In a circular knitting machine including a cylinder, a cam holder, a cam ring supporting the cam holder, a bed supporting the cam ring and cam holder and a gear ring fixedly attached to the cylinder and mounting the cylinder for rotation on said bed, the improvement comprising an oil leakage control and collection system for preventing oil stains on fabric being knit on the knitting machine, said system including a lower surface on said gear ring that is substantially free from protrusions and that is inclined downwardly and outwardly from the interior toward the outer periphery thereof, and means for collecting oil from said gear ring for reclamation.

2. A knitting machine according to claim 1 wherein said lower surface of said gear ring is inclined at an inclination within the range of about 1° to 8° from horizontal.

3. A knitting machine according to claim 2 wherein said lower surface of said gear ring has an inclination within the range of about 3° to 5° from horizontal.

4. A knitting machine according to claim 1 wherein said oil collecting means includes an oil collecting cavity in said bed underneath an outer portion of said gear ring, a reclamation pipe communicatively connected to said oil collecting cavity and means on said lower surface of said gear ring above said oil collecting cavity for causing leaked oil running on said inclined lower surface of said gear ring to drip therefrom into said oil collecting cavity.

5. A knitting machine according to claim 4, including at least one drain opening in said gear ring from an upper surface of said gear ring to the lower surface thereof immediately above said oil collecting cavity whereby any leaked oil on said upper surface of said gear ring will drain through said opening into said oil collecting cavity.

6. A knitting machine according to claim 1 wherein said gear ring is attached to said cylinder by fasteners located in counterbores in said lower surface.

7. A knitting machine according to claim 6, including oil leak preventing caps positioned in said counterbores and sealing said counterbores to prevent the leakage of oil therefrom.

8. A knitting machine according to claim 1 wherein said bed has a chamber for containing knitting machine parts, said chamber having a concave bottom and a drain opening in said bed from said concave bottom of said chamber to the lower surface of said bed, and including a reclamation pipe communicatively connected to said drain opening whereby any oil collecting in said chamber drains through said drain opening into said reclamation pipe.

9. In a circular knitting machine including a cylinder, a cam holder, a cam ring supporting said cam holder and a bed supporting the cylinder and cam ring, the improvement comprising a chamber in said bed for containing machine parts and having a concave bottom, a drain in said bed from said concave bottom of said chamber and a lower surface of said bed, and means for collecting oil from said drain for reclamation thereof.

* * * * *